US006047902A

United States Patent [19]

Hofmann

[11] Patent Number: 6,047,902

[45] Date of Patent: Apr. 11, 2000

[54] ROAD MARKING MACHINE WITH A PUMP COMBINATION DRIVEN IN PROPORTION WITH THE TRAVELING SPEED

[75] Inventor: Frank Hofmann, Hamburg, Germany

[73] Assignee: Walter Hofmann GmbH, Rellingen, Germany

[21] Appl. No.: 09/096,520

[22] Filed: Jun. 12, 1998

[30] Foreign Application Priority Data

Jun. 28, 1997 [DE] Germany ..... 197 27 622

[51] Int. Cl.[7] ..... A01G 25/09

[52] U.S. Cl. ..... 239/172; 239/62; 239/146; 239/332; 417/5; 417/533; 417/539; 222/278; 222/614; 222/621

[58] Field of Search ..... 239/62, 64, 69, 239/100, 146, 150, 155–158, 172, 332; 417/3, 4, 5, 46, 234, 533, 403, 539; 222/275, 614, 621, 278

[56] References Cited

U.S. PATENT DOCUMENTS 4,153,393 5/1979 Cook ..... 417/533 X
4,321,014 3/1982 Eburn, Jr. et al. ..... 417/5
4,436,230 3/1984 Hofmann ..... 222/621 X
4,832,580 5/1989 Tsuyoshi et al. ..... 417/290

FOREIGN PATENT DOCUMENTS 3007 116 C2 11/1986 Germany .

*Primary Examiner*—Andres Kashnikow
*Assistant Examiner*—Steven J. Ganey
*Attorney, Agent, or Firm*—Hill & Simpson

[57] ABSTRACT

A road marking machine comprising a spray gun and a combination of two displacement pumps for supplying the marking substance to the spray gun, wherein the combination is driven in proportion with the traveling speed and wherein the pumps, each after starting the positive displacement operation thereof, which starts during the supply operation of the corresponding other displacement pump, pre-compress the marking substance, then stops and continues the pressure stroke when the other displacement pump ends its supply, with hydraulic cylinders for driving the displacement pumps.

9 Claims, 3 Drawing Sheets

ROAD MARKING MACHINE WITH A PUMP COMBINATION DRIVEN IN PROPORTION WITH THE TRAVELING SPEED

BACKGROUND OF THE INVENTION

The invention relates to a road marking machine having at least one spray gun for a pumpable marking substance, such as paint, and a combination of two displacement pumps for dosably supplying the marking substance to the spray gun, wherein the combination of the two displacement pumps is driven in proportion with the traveling speed of the road marking machine.

Such a road marking machine is known from German patent application DE 30 07 116 C2. A serious disadvantage of that machine is the branched guiding of the paint streams after leaving the supply chambers of the pump, with the stream guided by valves. The 3/2-port-valves must be positively controlled in that their functional principle is for dividing the interrupted paint streams discharged from the supply chambers into a pulse free paint stream for the using units, and an interrupted remaining paint stream to be recycled to the reservoir. These valves are subject to high wear, in particular with abrasive paints. Furthermore, the valves are complicated and expensive with increasing operating pressures.

Besides the disadvantage associated with recycling a part of the paint stream to the reservoir, it is an additional disadvantage that this part paint stream has to be guided through a throttle, and the resistance of the throttle has to be adjusted to the resistance of the spray gun. Positively controlled valves for the control of paint streams are subject to high wear, in particular when the paints contain solid particles, and are complicated and expensive for high pressures. The same is true for the throttle.

It is a further disadvantage that the pump has to be driven even when the marking lines are interrupted, and that during the interruption the paint stream dedicated for the spray gun has to be recycled back to the reservoir through a valve to be opened and a throttle adjusted to the resistance of the spray gun.

This constant pumping is necessary to have the required spray pressure ready when the spray gun is opened again when a new part of the marking line is started.

The branched guidance of the paint with many paint contacting members is also a disadvantage when the unit has to be designed in stainless steel for paints being aggressive for normal steel, which again will greatly increase the manufacturing costs.

The process known from the patent document cited above has the further disadvantage that the two displacement members are mechanically driven through cam plates. The economic transfer of forces in this manner is limited for the sizes of the utilized pumps. Pumps of this type have been known only for the low pressure range with spray pressures up to 15 bar. For the high pressure range with pressures up to 200 bar, such a mechanical drive would be very heavy, very complicated, and costly for the higher forces involved.

SUMMARY OF THE INVENTION

It is an object of the invention to further develop a generic road marking machine, such that with a simplified construction of the pump combination, a trouble free and almost maintenance free operation is provided. This object is attained with a generic road marking machine in which a pump combination is provided comprising two single oscillating displacement pumps, wherein the single pumps, each after starting the positive displacement operation thereof, which starts during the supply operation of the corresponding other displacement pump, pre-compresses the paint with an outlet valve closed up to a pressure close or equal to the supply pressure of the supplying displacement pump, then stops while holding the pre-compression final pressure reached, and continues the displacement operation while supplying the paint only when the corresponding other displacement pump ends its supply. The term positive displacement in this context is a movement of the displacing element decreasing the volume of the pump supply chamber. The pulsing, when transferring the supply from the one single pump through the other pump, therein depends on the difference between supply pressure and the end pressure reached at the pre-compression, and is very small. The term marking substance includes various substances, but as a specific example useful in an embodiment of the invention described herein, the term paint will be used throughout this disclosure, not in a limiting sense, but rather merely as a specific example.

The control for attaining a low pulse supply is attained at the drive side of the displacing members with pumps of such a supply operation. The total paint volume leaving the pump supply chambers is pumped to the spray pistol or may be reserved for the spray pistol, respectively. The paint flow path system is simple. Other than the check valves associated with the pump supply chambers, no further control valves, which are complicated and subject to wear for deviating the paint streams, are required, and no throttles for influencing the pressure are required either. The number and complexity of the paint contacting construction members is small, leading to lower cost when adapting the materials to the requirements of the paint.

The pumps of the road marking machine are driven such that the supply volume, when changing the traveling speed, will vary in the same ratio as the traveling speed. With varying paint volumes, the supply pressure will also vary, as the outlet cross-section of the spray pistol remains the same. With varying supply pressure, the difference between supply pressure and fixedly adjusted pre-compression final pressure will also vary, and thereby the amplitude of the supply volume pulse when transferring the supply from the one pump supply chamber to the other will vary. Pulses, however, generate thin areas or interruptions in the marking line to be generated and have to be avoided for this reason.

According to the invention, an automatic adaption of the pre-compression final pressure to the supply pressure is attained.

By means of the supply pressure of the currently supplying single pump, up to the end of the displacing operation thereof, the end pressure of the pre-compression of the other single pump is controlled to a value in proportion with the supply pressure.

According to the invention, the supply pressure of the single pump currently supplying to the spray gun is used as a control value for the device which interrupts the displacement operation of the other single pump as it reaches a pre-compression pressure, defined by the supply pressure, while holding this pressure.

During the interruption of a line, i.e., with a closed spray gun, the paint pressure has to be held at a pressure which corresponds to the spraying pressure of an opened spray gun during the application of a line, in order to have the spray pressure ready, which is required for a good spray quality at the beginning of the spraying at the start of a further line part. This is attained, according to an embodiment of the invention, such that when the spray gun is closed, the oil stream for driving the pump finds a side exit open through which the oil stream is guided into the oil reservoir through a throttle generating the required pressure, wherein the pump will be stopped. The counter-pressure generated by the throttle therein is depending on the size of the oil stream being in proportion to the traveling speed, in the same manner as the paint pressure generated during the pump operation through the nozzle of the spraying gun is dependent on the size of the paint stream being in proportion with the traveling speed.

The invention is now further explained referring to a drawing depicting the example of a combination of two displacement pumps wherein the positive and negative displacement is attained by rigid displacing members displaceable in cylinders.

DETAILED DESCRIPTION OF THE PREFERRED EMBODIMENTS

Figure 1:
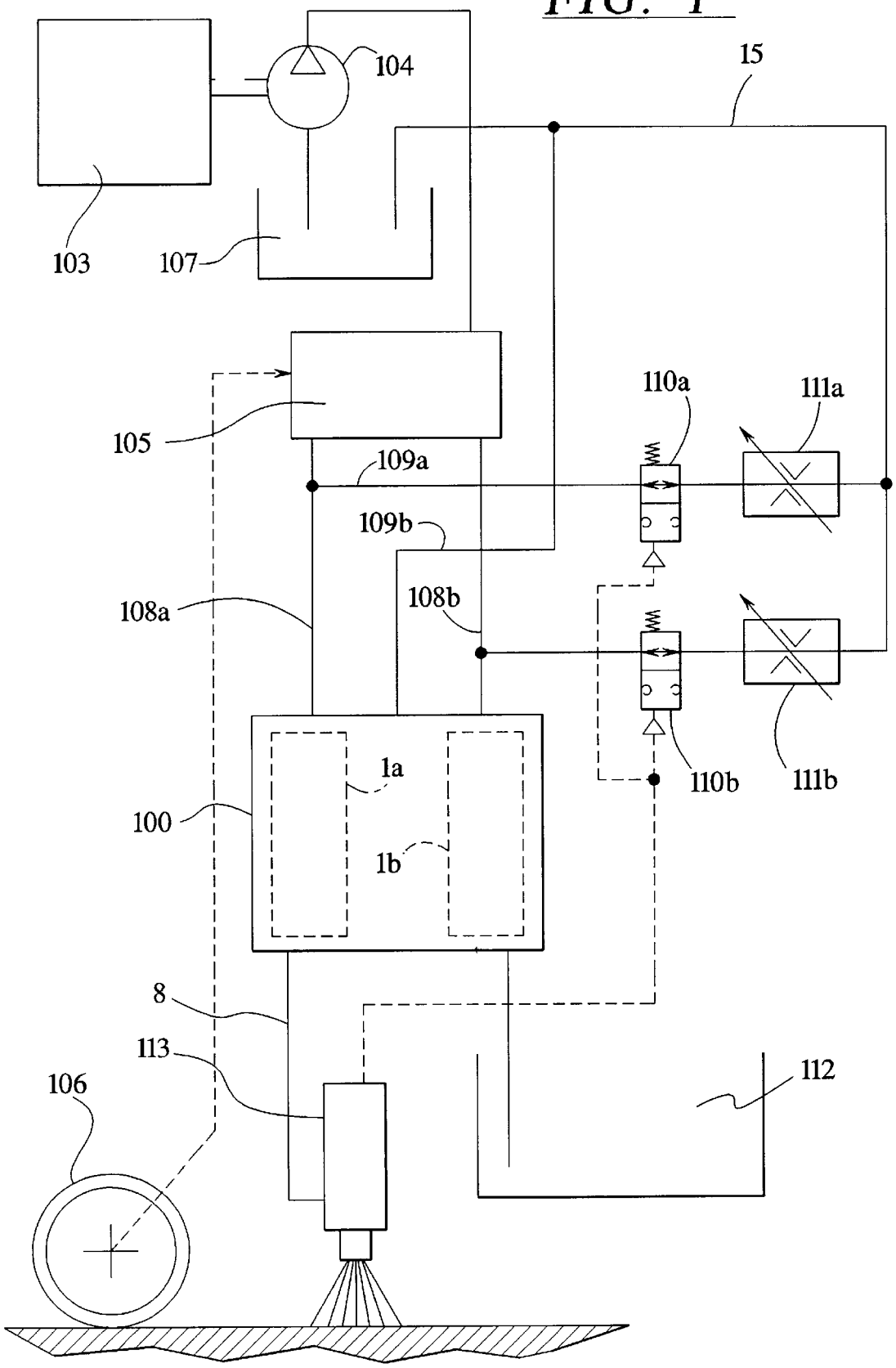
FIG. 1 schematically illustrates the total design of the road marking machine, in principle.

Referring to FIG. 1, displacement pumps 1*a* and 1*b* combined in a pump combination 100, are driven by two oil streams through ducts 108*a* and 108*b*, with the oil streams, in the size thereof, proportional with the traveling speed and equal with each other. The generation of these two oil streams from one oil stream, supplied by a hydraulic pump 104 driven by an internal combustion engine 103, is attained in a control unit 105, which is not further explained, while supplying a traveling speed signal which, e.g., is derived from a wheel 106 rolling on a road.

The backstream of the hydraulic oil from the pump combination 100 to an oil tank 107 is attained through a duct 15. A side outlet duct 109*a* or 109*b*, respectively, is connected to the ducts 108*a* and 108*b* to the pump combination 100, with the side outlet lines leading to 2/2-port-valves 110*a* or 110*b*, respectively, wherefrom again ducts lead to throttles preferably to adjustable throttles 111*a* or 111*b*, respectively. The outlet sides of these throttle valves are connected with the duct 15.

The pump combination 100 sucks paint from a reservoir 112 and supplies it through a duct 8 to a spray gun 113. Simultaneously with the closing of the spray gun 113 the valves 110*a* and 110*b* are opened. After closing the spray gun, when the pump combination 100 stands still, the oil streams being supplied through the ducts 108*a* and 108*b* now are discharged through the ducts 109*a* or 109*b*, respectively, through the opened valves 110*a* or 110*b*, respectively, and subsequently through the throttles 111*a* or 111*b*, respectively, to the oil tank 107. The throttles must be adjusted in such a way that the oil pressure acting in the ducts 109*a* or 109*b*, respectively, and therefore in the non-actuated pump combination 100, corresponds to the oil pressure which occurs when the spray gun 113 is open and the pump combination 100 is working.

Figure 2:
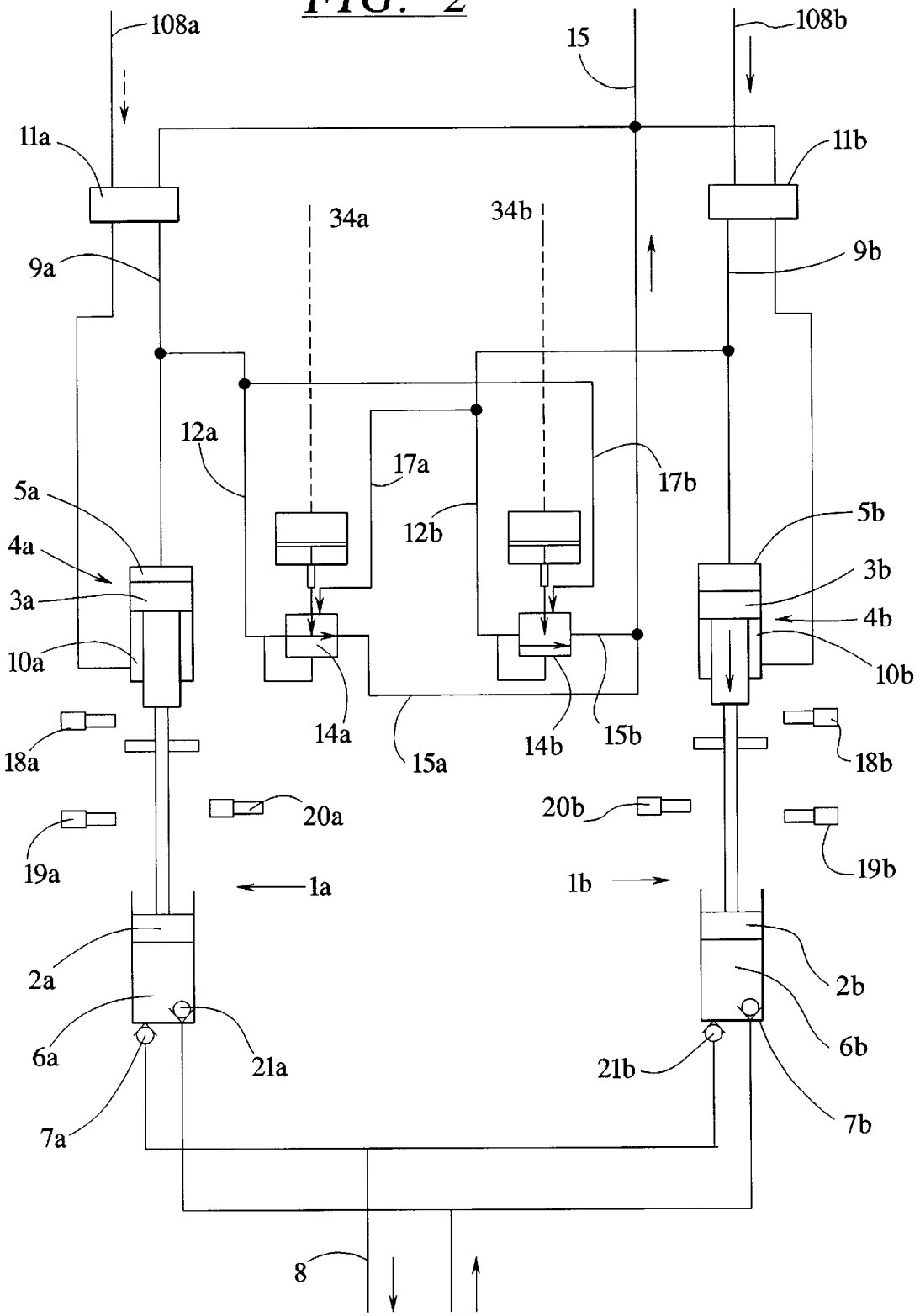
FIG. 2 schematically illustrates the construction of the pump combination from FIG. 1, in principle.

Referring to FIG. 2, the pump combination 100 of FIG. 1, comprising the two displacement pumps 1*a* and 1*b*, is explained:

The displacement pumps 1*a*, 1*b* comprise displacing members 2*a*, 2*b* which are connected with pistons 3*a*, 3*b* of hydraulic cylinders 4*a*, 4*b*, such that a movement of the hydraulic pistons 3*a*, 3*b* is transferred to the displacing members 2*a*, 2*b*. With a movement of the pistons 3*a*, 3*b*, because of oil supply to cylinder chambers 5*a*, 5*b*, the paint which is contained in the pump chambers 6*a*, 6*b* is compressed, and after reaching the pressure acting in the duct 8 to the spray gun 113, is pressed through an outlet valve 7*a*, 7*b* into the duct 8. The hydraulic oil is fed to the cylinder chambers 5*a*, 5*b* through ducts 9*a*, 9*b*. For accomplishing the suction stroke, the hydraulic oil is supplied to cylinder chambers 10*a*, 10*b*. The control of the oil streams to the cylinder chambers is accomplished by means of valves 11*a*, 11*b* which are fed with the oil through ducts 108*a*, 108*b*. Each of the two displacement-piston-combinations 2*a*, 3*a* and 2*b*, 3*b* oscillates between an upper and a lower reverse position. Switches or sensors 18*a*, 18*b* and 19*a*, 19*b* in the reverse position sense the position of the corresponding displacement-piston-combination and control the oil streams by switching the corresponding hydraulic valves 11*a*, 11*b* such that the stroke is reversed. The upwards stroke is the pressure or supply stroke, respectively. The downward stroke is the suction stroke.

Ducts 12*a*, 12*b* are connected with the ducts 9*a*, 9*b*. The ducts 12*a*, 12*b* lead to pressure controllers 14*a*, 14*b* and then to the common duct 15 through connection ducts 15*a*, 15*b* back to the oil tank 107. The pressure controllers 14*a*, 14*b* are designed such that an oil stream is passed only when a certain pressure is reached, with the pressure defined by the pressure in the cylinder chambers 5*a* or 5*b*, respectively, of the pump 1*a* or 1*b*, respectively, supplying just into the duct 8. For this reason the pressure controllers 14*a*, 14*b* are connected with control pressure ducts 17*a*, 17*b* to the cylinder chambers 5*a*, 5*b*.

The pressure controller 14*a* associated with the pump 1*a* is connected with the cylinder chamber 5*b* of the pump 1*b* through the duct 17*a*, and the pressure controller 14*b* of the pump 1*b* is connected with the cylinder chamber 5*a* of the pump 1*a* through the duct 17*b*.

Shortly prior to the switch 19*a*, 19*b* enacting the reverse of the supply stroke to the suction stroke, there is a further switch 20*a*, 20*b*. The object of this switch is to enact an interruption of the oil stream through the ducts 12*a* or 12*b*, respectively, to the oil tank, and that of the other pump standing still at the end of the pre-compression stroke. Therefore, the switch 20*a* is dedicated for the interruption of the oil stream through the duct 12*b*, and the switch 20*b* is dedicated for the interruption of the oil stream through the duct 12*a*.

The pump 1*b* is illustrated in the supply operation, i.e., it supplies paint through the opened outlet valve 7*b* into the duct 8 to the spray gun 113. The pressure acting in the cylinder chamber 5*b* and therefore in the ducts 9*b*, 12*b* and 17*a* depends on the pressure of the paint in the pump chamber 6*b*.

The pump 1*a* is illustrated standing still after the pre-compression stroke is finished. The pressure controller 14*a* is in the opened position such that the hydraulic oil streaming into the duct 9*a* is discharged through the duct 12*a* to the duct 15. Therein, the pressure in the duct 9*a*, and therefore in the cylinder chamber 5*a*, and also the pressure in the pump chamber 6*a*, is maintained at a value by the pressure controller 14*a* which is defined by the geometric design in the pressure controller 14*a* and by the pressure of the cylinder chamber 5*b* of the pump 1*b* acting as a control pressure through the duct 17*a* onto the pressure controller.

When the displacing member 2*b*, during the supply stroke, reaches the switch or sensor 20*b*, this switch or sensor enacts the interruption of the oil stream through the duct 12*a*. This may be accomplished by different means, e.g., by check valves in the ducts 12*a*, 12*b*. In the example illustrated, this is accomplished by enacting an additional force onto the valve slider of the pressure controller 14*a*, whereby the pressure controller is closed. Thereupon, the displacing member 2*a* continues its pressure stroke now as a supply stroke, wherein paint is pressed or forced through the opening outlet valve 7*a* into the duct 8 to the spray gun 113.

When the displacing member 2*b*, at the end of the supply stroke thereof, reaches the lower dead point, the suction stroke is triggered by the switch 19*b*, whereupon the outlet valve 7*b* closes and the paint streams through an opening inlet valve 21*b* (or 21 a in the left pump 1*a*) into the chamber 6*b*.

By means of adjusting the distance between the switches 20*b* and 19*b*, a lag between the switch signal and completed valve switch may be compensated such that a continuous supply stroke of the pump 1*a*, to the ending supply stroke of the pump 1*b*, is accomplished.

When the displacing member 2*a* is in the supply stroke, the displacing member 2*b* enacts the suction stroke because the supply of hydraulic oil into the cylinder chamber 12*b*, with the velocity of the suction stroke, is larger than that of the pressure stroke. The switch or sensor 18*b*, respectively, enacts the completion of the suction stroke, and a transfer to the pressure stroke, which begins with the pre-compression of the paint. The oil pressure resulting in the duct 9*b* to the cylinder chamber 5*b* is also present in the pressure controller 14*b* through the duct 12*b*. The pressure controller remains closed up to reaching the opening pressure because the oil pressure from the cylinder chamber 5*a* of the pump 1*a* enacting the supply stroke with the oil pressure being the control pressure acting on the pressure controller through the duct 17*b*. The size of the opening pressure, as has been explained before, is defined by the geometric design in the pressure controller and by the control pressure. After opening the pressure controller 14*b*, the hydraulic oil supplied through the duct 9*b* streams through the duct 15 to the oil tank 107, while holding the opening pressure.

Figure 3:
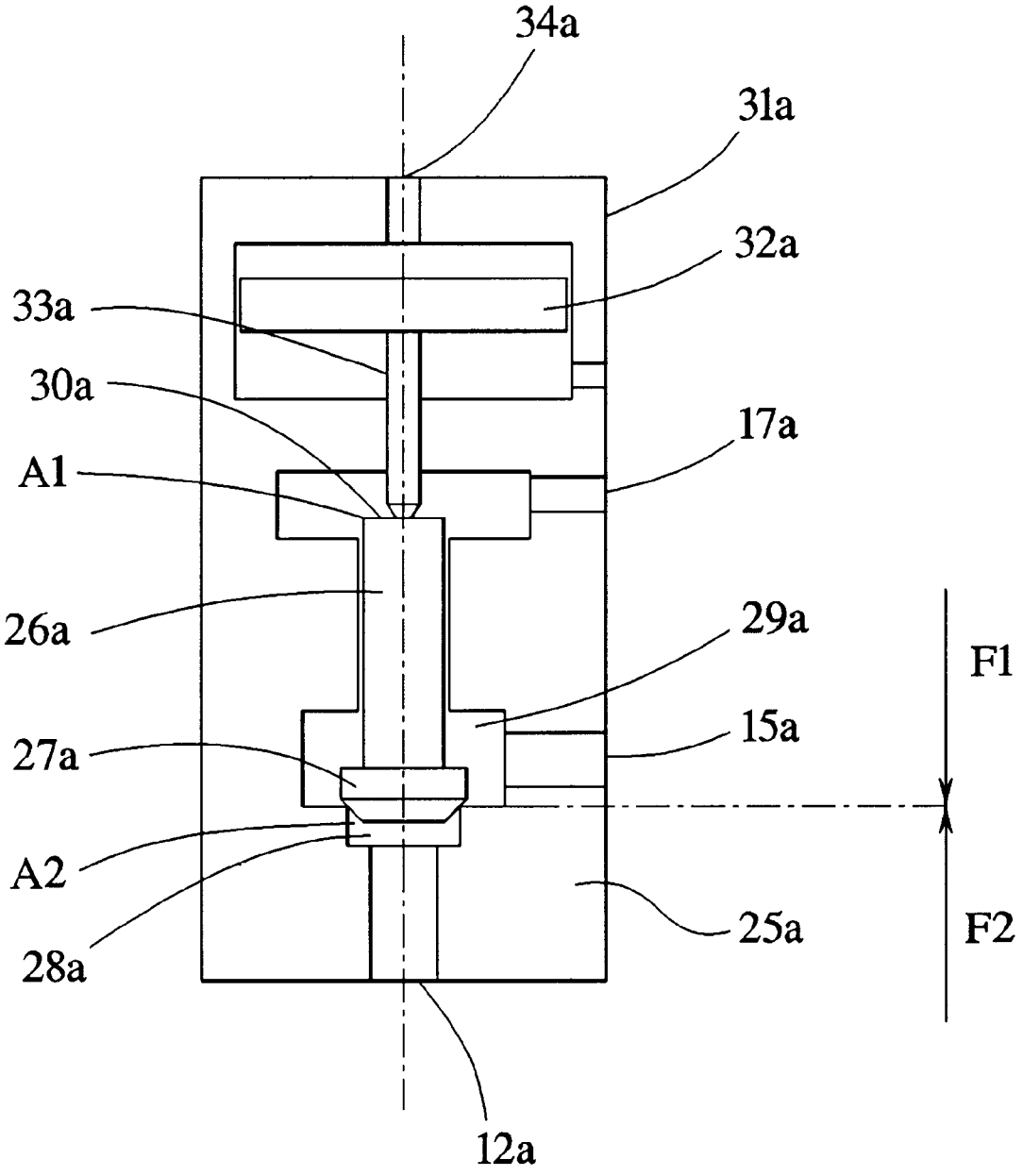
FIG. 3 illustrates a side sectional view of one of the two pressure controllers of FIG. 2 for one of the two hydraulic streams to the hydraulic cylinders.

In FIG. 3, one of the two pressure controllers which have the same function is illustrated, in an example of the pressure controller 14*a*. In a housing 25*a* there is a slider 26*a* containing, at the end thereof, a conical closing member 27*a*. This conical member closes an opening 28*a*, with a cross section $A_2$, which is connected with the duct 12*a* and thereby with the hydraulic cylinder chamber 5*a*. In direction towards the closing member 27*a*, the opening 28*a* is enlarged to form a chamber 29*a*. The chamber 29*a* is connected with the duct 15 leading to the oil tank 107. The end of the slider 26*a* facing away from the closing member 27*a* has an effective cross-section A, and together with the housing 25*a* forms a chamber 30*a*. This chamber 30*a* is connected with the duct 17*a* and thereby with the hydraulic cylinder chamber 5*b* of the pump 1*b*, with the pump supplying paint into the duct 8 to the spray gun 113.

Furthermore, the housing 25*a* comprises a chamber 31*a* with a piston 32*a*. The latter is connected with a piston rod 33*a* which projects in a sealing fashion towards the housing 25*a* into the chamber 30*a* and presses onto the front face of the slider 26*a* when the chamber 31*a* is under pressure. The hydraulic oil is supplied to the chamber 31*a* through a duct 34*a*.

By the oil pressure in the chamber 30*a*, a force $F_1$ equaling $A_1 \times p_{(5b)}$ acts on the slider 26*a*, wherein $P_{(5b)}$ is the hydraulic pressure of the cylinder chamber 5*b*. In the opening 28*a*, a force $F_2$, equaling $A_2 \times p_{(5a)}$, in direction opposite to $F_1$ acts on the slider, wherein $p_{(5a)}$ is the hydraulic pressure of the cylinder chamber 5*a* of the pump 1*a* accomplishing the pre-compression stroke. While the force $F/_2$ increases from zero with increasing pre-compression in the pump chamber 6*a*, and therefore with correspondingly increasing hydraulic pressure $p_{(5a)}$, the force $F_1$ has a constant value. When the force $F_1$ is equal to $F_2$, the closing force for the opening 28*a*is zero and the hydraulic oil begins to stream or flow from the opening 28*a* through the chamber 29*a* to the duct 15*a* when the closing member 27*a* opens. The accomplished oil pressure corresponds to the end pressure of the pre-compression of the paint in the pump chamber 6*a*. Now the piston displacement combination 3*a*, 2*a* comes to a standstill. The furthermore streaming oil through the duct 9*a* will then stream through the pressure controller 14*a* to the duct 15, wherein the oil pressure in the opening 28*a* is held constant by the force $F_1$ acting on the opening. The ratio of the pre-compression end pressure of the pump 1*a* to the supply pressure of the pump 1*b* is defined by the area ratio $A_1$:$A_2$ and is not dependent on the value of the supply pressure.

When the oil stream through the opening 28*a* has to be stopped, the pressure control chamber 31*a* is impinged with pressure by the switch 20*b* through the duct 34*a*, such that an additional force results which is required for closing the opening 28*a*. The piston displacement combination 3*a*, 2*a* then enacts the pressure stroke as a supply stroke beginning from the stand-still situation. By a control, which is not further illustrated, the impingement of the pressure control chamber 31*a* with pressure is held at least up to the end of the supply stroke.

When the outlet valves 7*a*, 7*b* are designed as automatically opening valves, e.g., as illustrated as check valves by means of the area ratio $A_1$:$A_2$, the pre-compression end pressure has to be selected smaller than the supply pressure. Otherwise the valves 7*a*, 7*b* would be opened against the supply pressure acting in the duct 8 as a consequence of the pre-compression pressure increasing above the supply pressure. This would mean that in this case both pumps would supply into the duct 8. In the case that the outlet valves 7*a*, 7*b* are provided as positively controlled valves with the control enacted by additional energy, or, when with an additional energy, an additional closing force has to be provided, then the pre-compression end pressure has to be selected equal to or larger than the supply pressure.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A road marking machine comprising at least one spray gun for a pumpable marking substance, and a combination of two displacement pumps for dosably supplying the marking substance to the at least one spray gun, wherein the combination of the two displacement pumps is driven in proportion with a traveling speed of the road marking machine and wherein the two pumps, each after starting the positive displacement operation thereof, which starts during a supply operation of the corresponding other displacement pump, pre-compresses the marking substance with an outlet valve closed up to a pressure approximately equal to the supply pressure of the supplying displacement pump, then stops while holding the pre-compression final pressured reached, and continues the displacement operation while supplying the marking substance only when the supply of the corresponding other displacement pump ends.

2. The road marking machine according to claim 1, wherein displacing members of the two pumps are operatively connected with driving hydraulic cylinders.

3. The road marking machine according to claim 2, wherein each hydraulic cylinder is connected with a pressure controller which comprises a slider with an effective area $A_1$ which is impinged by oil pressure of the hydraulic cylinder performing the pressure stroke of the corresponding other displacement pump, wherein the slider comprises a closing member pressing on an opening having a cross-section $A_2$, wherein in the closed position of the closing member, the cross-section $A_2$ is presented with the pressure of the hydraulic cylinder performing the pressure stroke of the corresponding other displacement pump, wherein in the opened position of the closing member, the cross-section $A_2$ is presented with the pressure defined by the area ratio $A_1$:$A_2$, and the pressure on the area $A_1$, and the opened position of the closing member is switchable into the closed position upon a signal of a switch sensing a position of a hydraulic piston.

4. The road marking machine according to claim 3, wherein the pressure controller comprises a piston engageable by a pressure medium, with the piston pressing on the slider through a piston rod acting on the area $A_1$ of the slider.

5. The road marking machine according to claim 3, wherein with a closed spray gun, the oil stream for the hydraulic cylinder of the pump pressurizing the marking substance in the duct up to the supply pressure, discharges through one of a 2/2-port-valve and a throttle.

6. The road marking machine according to claim 5, wherein the throttles are adjustable.

7. The road marking machine according to claim 6, wherein a counter-pressure generated by the throttle depends on a magnitude of the oil stream being in proportion with the traveling speed.

8. A road marking machine comprising at least one spray gun for a pumpable marking substance, comprising:

a combination of two displacement pumps for dosably supplying the marking substance to the at least one spray gun;

each displacement pump having an outlet connected to the at least one spray gun, with a check valve in said outlet exposed to said outlet of said other displacement pump, such that each such check valve is closed by a pressure approximately equal to a supply pressure of said other displacement pump;

two hydraulic motors, driven in proportion with a traveling speed of the road marking machine, for driving said two displacement pumps;

two pressure controllers for operating said displacement pumps, said pressure controllers being arranged to receive an output from said hydraulic motors and to direct pressurized hydraulic fluid to said displacement pumps, such that said displacement pumps are operated alternatively.

9. The road marking machine according to claim 8, including a position switch associated with each hydraulic motor to sense a position of a piston of each motor, and wherein said two pressure controllers comprise a pressure controller associated with each hydraulic motor, each pressure controller having a slider with an effective area $A_1$ which is acted upon by hydraulic fluid pressure performing a pressure stroke of the other hydraulic motor, and said slider having a closing member extending into an opening having a cross-section area $A_2$, wherein, in the closed position of the closing member, the cross-section $A_2$ is presented with the hydraulic fluid pressure performing the pressure stroke of the other displacement pump, wherein in the opened position of the closing member, the cross-section $A_2$ is presented with the pressure defined by the area ratio $A_1$:$A_2$, and the pressure on the area $A_1$, and the opened position of the closing member is switchable into the closed position upon a signal of one of said switches associated with said hydraulic motors.

* * * * *